United States Patent [19]

Veldman et al.

[11] 4,097,112

[45] Jun. 27, 1978

[54] TILTING TERMINAL CLAMP ASSEMBLY

[75] Inventors: Donald Richard Veldman, Oak Lawn, Ill.; Howard S. Langdon, 1250 Hill Rd., Winnetka, Ill. 60093

[73] Assignee: Howard S. Langdon, Winnetka, Ill.

[21] Appl. No.: 793,444

[22] Filed: May 4, 1977

Related U.S. Application Data

[63] Continuation-in-part of Ser. No. 719,897, Sep. 2, 1976, abandoned.

[51] Int. Cl.[2] ..... H01R 9/10

[52] U.S. Cl. ..... 339/246

[58] Field of Search ..... 339/95, 246, 269, 271, 339/272, DIG. 2; 151/37

[56] References Cited

U.S. PATENT DOCUMENTS

| | | | |
|---|---|---|---|
| 2,270,813 | 1/1942 | Olson | 151/37 |
| 2,709,470 | 5/1955 | Knohl | 151/37 |
| 3,744,012 | 7/1973 | Gutshall | 339/246 |
| 3,891,296 | 6/1975 | Gutshall | 339/246 |
| 3,993,397 | 11/1976 | Gutshall | 339/246 |

FOREIGN PATENT DOCUMENTS

| | | | |
|---|---|---|---|
| 1,173,759 | 10/1958 | France | 339/272 A |

*Primary Examiner*—Joseph H. McGlynn

*Attorney, Agent, or Firm*—Tilton, Fallon, Lungmus & Chestnut

[57] ABSTRACT

A tilting terminal clamp assembly including a threaded shank, a clamping plate, and means for retaining the clamping plate on the threaded shank, wherein the clamping plate associated with the threaded shank has a generally polygonal perimeter having 6, 8 or 10 sides to adjustably conform to a terminal body pocket, and having surfaces equipped with radially directed serrations to engage a wire in the pocket.

5 Claims, 9 Drawing Figures

FIG. 1
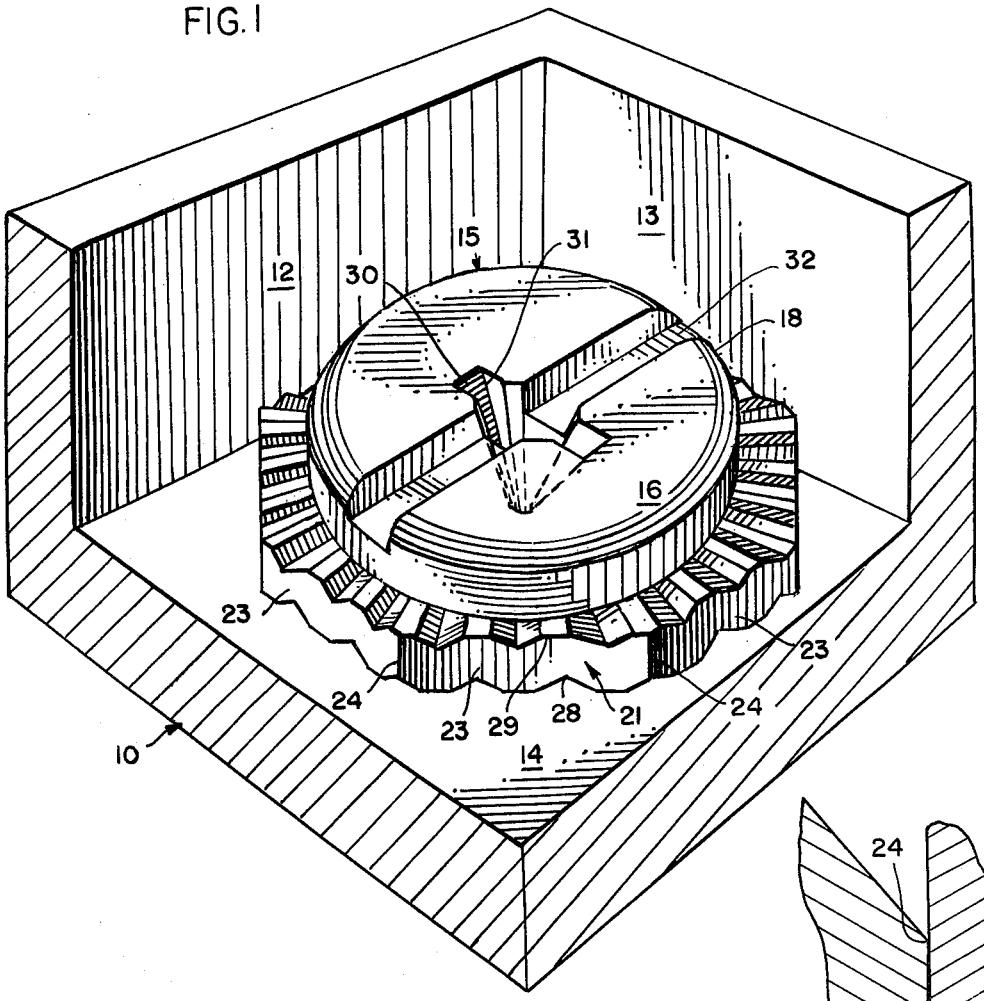
FIG. 2
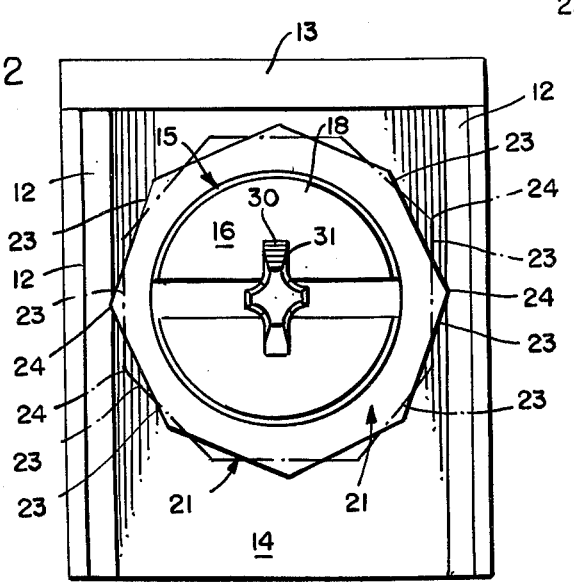
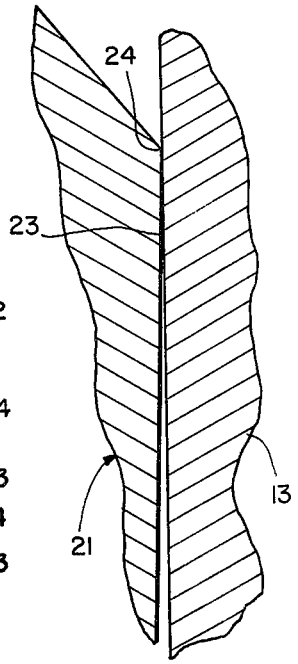
FIG. 2A

TILTING TERMINAL CLAMP ASSEMBLY

This is a continuation-in-part of application Ser. No. 719,897 filed Sept. 2, 1976, now abandoned.

BACKGROUND AND SUMMARY OF INVENTION

This invention is an improvement on prior art terminal clamps shown and described in a number of earlier patents such as U.S. Pat. Nos. 2,709,490; 3,372,366; 3,398,393; 3,509,521; 3,744,012; 3,891,296; and 3,993,397 all having to do with securing wires within terminal body pockets which are widely used in the electrical and electronics industries.

It is desirable to automate both the manufacture and installation of terminal clamps to the degree possible because of the difficult and time-consuming nature of hand assembly. Terminal clamps are usually relatively small and massive numbers are produced for a multitude of purposes which emphasizes the desirability of accomplishing this result. It is an object of this invention therefore to automate the handling of terminal clamps by providing a novel tilting terminal clamp assembly which also improves upon the reliability of the clamping function.

The reliability of the clamping function was approached in the art by going to a tilting type clamp — as evidenced by U.S. Pat. No. 3,733,012. However, this did not solve the problem of quick feeding, viz., automatic handling. The square plates had to be oriented properly for introduction into the pockets which defeated quick feeding. An approach to solving this is found in U.S. Pat. No. 3,993,397 which converted the square plate to a round one and equipped the periphery with serrations or teeth — would like a multi-tooth gear. However, these teeth had to engage the sidewalls of the pocket — either by biting engagement or by fitting within previously provided grooves, or spaced ribs. Either way caused problems in having to maintain tolerances — something quite difficult in high speed, low cost operations.

This has been achieved by the instant invention which employs a polygonal plate having 6, 8 or 10 sides. With such a structure the clamping plate has opposed flat sides and opposed corners. With a minimum tolerance pocket, the plate fits with the flat sides engaging the pocket sidewalls but with a maximum tolerance pocket the corners are in engagement.

Other objectives of the present invention can be appreciated from the details of construction and operation as further set forth and described in the specification, claims, and drawings.

DETAILED DESCRIPTION

The invention is described in conjunction with the accompanying drawings, in which FIG. 1 is a fragmentary perspective view of a portion of a terminal body equipped with the tilting terminal clamp of the present invention;

FIG. 2 is a plan view of a terminal body equipped with the tilting terminal clamp illustrating adaptability of the tilting terminal clamp to wall variations in the terminal body;

FIG. 2A is an enlarged fragmentary sectional view illustrating how the corner and a portion of the sidewall of the clamping plate engage the sidewall of the pocket in the terminal body.

Figure 6:
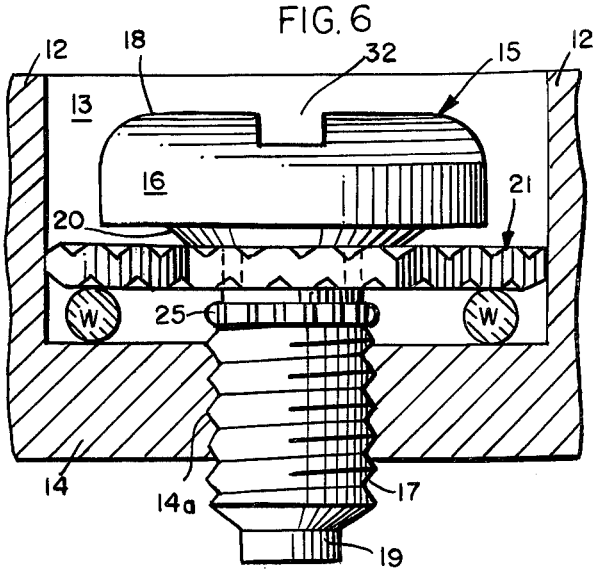
FIG. 6 is a cross-sectional view of a terminal body equipped with the tilting terminal clamp in an operational orientation gripping two wires of the same diameter.
Figure 4:
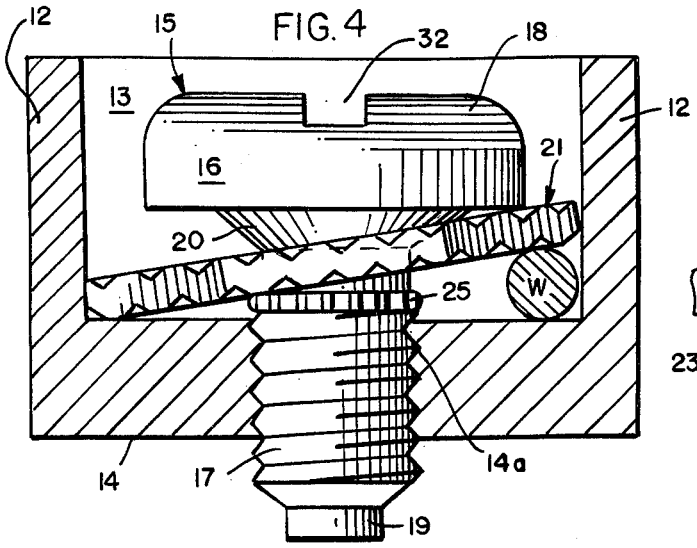
FIG. 4 is a cross-sectional view of a terminal body equipped with the tilting terminal clamp in an operational orientation gripping a wire.
Figure 5:
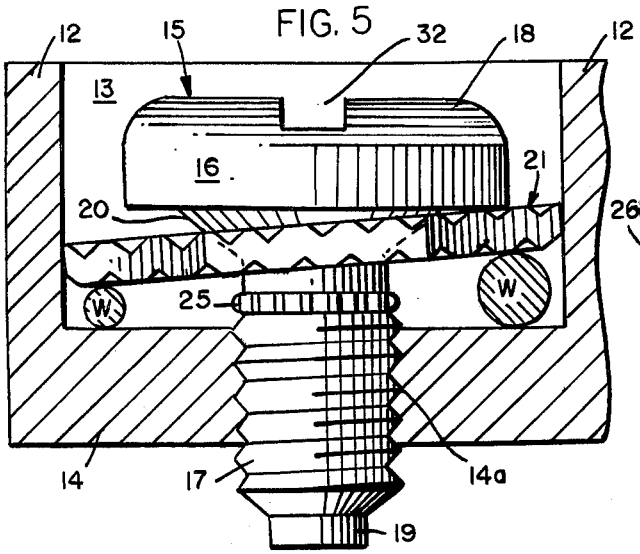
FIG. 5 is a cross-sectional view of a terminal body equipped with the tilting terminal clamp in an operational orientation gripping two wires of varying diameter.

Referring to FIG. 1, a portion of a terminal body 10 which is employed for securing electrical connections is equipped with a pocket 11 defined by sidewalls 12 (see FIG. 2) and an end wall 13 all upstanding from a terminal plate 14. The terminal plate 14 constitutes the bottom wall of the pocket 11 and the pocket 11 is open at one end (as shown in FIGS. 4, 5 and 6) to receive a wire or wires W. The pocket 11 also has an open top for the introduction of a tilting terminal clamp 15 during manufacture and installation.

Figure 3:
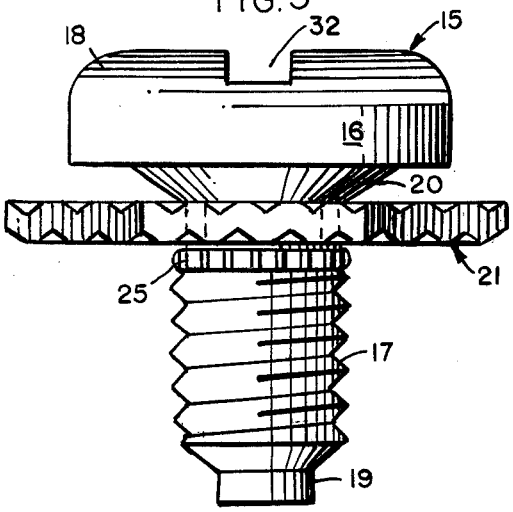
FIG. 3 is a cross-sectional view of the tilting terminal clamp.

The tilting terminal clamp 15 includes a screw 16 having a threaded shank 17. The threaded shank 17 (as shown in FIG. 3) includes a head 18 at the upper extremity and a lead point 19 at the lower extremity. The lead point 19 (as shown in FIGS. 4, 5 and 6) illustrates introduction of the threaded shank 17 into a threaded aperture **14*a* in the terminal plate 14. The screw 16 also includes a conical ramp 20 which joins the head 18 to the threaded shank 17**.

Figure 7:
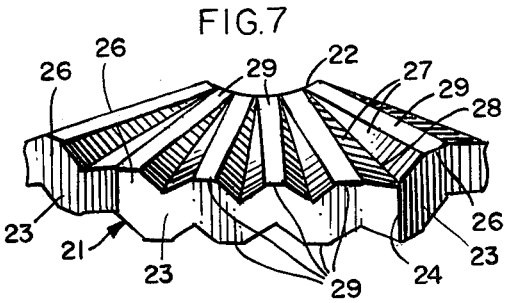
FIG. 7 is a fragmentary perspective view of the clamp plate portion of the tilting terminal clamp.
Figure 8:
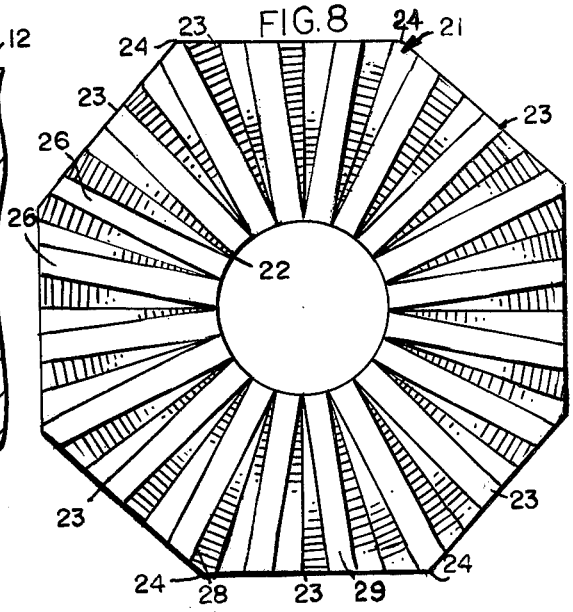
FIG. 8 is a plan view of the clamp plate portion of the tilting terminal clamp.

A clamping plate 21 is mounted on the threaded shank 17 near the head 18. The clamping plate 21 includes a central aperture 22 (as shown in FIG. 8) and a generally polygonal perimeter defined by sides 23 (as shown in FIG. 7) which intersect at corners 24. The sides 23 adjacent the corners 24 are adapted to engage the sidewalls 12 of the terminal body pocket 11 to prevent rotation of the clamping plate 21.

This arrangement provides distinct advantages over the prior art — notably U.S. Pat. No. 3,993,397. The problem with this construction is that it required a very close tolerance — the clamping plate had to be within 0.001 inch of the walls of the pocket. In significant contrast to this, the instant invention eliminates the need for such close tolerances while, at the same time, providing corner portion to cooperate with the pocket walls. For example, a No. 6 size terminal screw when equipped with an octagonal clamping plate has a dimension of 0.308–0.312 inch when measured between opposite "flats," i.e., the flat sides of the octagon. On the other hand, the dimension between opposing corners is 0.330–0.335. The nominal size of a 5/16 inch pocket is 0.312 inch but frequently may be larger. From the foregoing, it will be seen that the instant invention allows a substantial range of imperfection in the terminal pockets (always possible in machine built units such as terminals). This is of the order of twenty times the tolerance permitted by the prior art.

It will be appreciated that this tolerance compensation is only available with an even-sided polygon, i.e., where the sides are opposed — or conversely, the corners are opposed. An octagon, as shown, is the preferred form although a six or a 10 sided polygon can be used to advantage. In the six-sided form, clamping area is sacrificed while in the ten-sided version, there is less tolerance compensation.

Referring again to FIG. 3, an interrupted annulet 25 is provided to maintain the clamping plate 21 on the threaded shank 17 beneath the underside of the head 18 in close proximity to the conical clamp 20. The interrupted annulet 25 resembles a series of projections and depressions, the projections serving to confine movement of the clamping plate 21 is therefore lifted by the projections of the interrupted annulet 25 when the screw 16 is loosened within the terminal body 10 to facilitate inserting or removing a wire or wires W.

The central aperture 22 of the clamping plate 21 is preferably dimensioned only slightly larger than a blank of the screw 16 having a smooth shank. A threading operation can then preferably be utilized to provide the lower portion of the shank with threads having a major diameter greater than the diameter of the smooth shank. An annulet forming generation can then likewise preferably be utilized to provide the interrupted annulet with projections having a major diameter greater than the diameter of the smooth shank. The clamping plate 21 can therefore be placed on the smooth shank of the blank of the screw 16 in close proximity to the conical ramp 20 and can thereafter be securely maintained in position by utilizing the preferred threading and annulet forming operations.

Referring again to FIGS. 7 and 8, the details of the clamping plate 21 will be discussed. The clamping plate 21 (as shown in FIG. 7) includes a portion of two sides 23 intersecting at a corner 24 and a portion of the central aperture 22. The central aperture 22 of the clamping plate 21 is generally circular and is equipped with a rounded edge to facilitate engagement of the clamping plate 21 with the conical ramp 20. The clamping plate 21 has a generally similar polygon perimeter which can advantageously be octagonal (as shown in FIG. 8) providing a generally washer-like configuration but departing therefrom in providing the advantageous corners 24.

The clamping plate 21 is arranged to tip relative to the screw 16 to advantageously perform a tilting clamping function (as shown in FIG. 4) where only one wire W has been placed under one side of the clamping plate 21. A significant axial pressure upon the wire W relative to any applied torque is provided in this configuration by the clamping plate 21 since the degree of angularity is normally within about 15° to 20°. The clamping plate 21 provides the axial pressure upon the wire W by reason of various contact points. First, the underside of the clamping plate 21 bears against the wire W. Second, the central aperture 22 of the clamping plate 21 bears against the conical ramp 20 on the same side. Thirdly, the central aperture 22 of the clamping plate 21 bears against either the conical ramp 20 or the screw 16 on the other side. Fourth, the underside of the clamping plate 21 bears against the terminal plate 14. The clamping plate 21 therefore provides at least four principal contact points essentially precluding loosening of the wire W when the screw 16 has been tightly installed in the threaded aperture **14*a* in the terminal plate 14. The clamping plate 21 tips to a lesser degree relative to the screw 16 (as shown in FIGS. 5 and 6) where two wires W of the same or different diameters have been placed on opposite sides of the clamping plate 21** thereby providing even greater axial pressure upon the wires W in these configurations.

The clamping plate 21 includes a series of radially directed serrations 26 (as shown in FIGS. 7 and 8) which are adapted to engage a wire clamped within a terminal body pocket 11. The radially directed serrations 26 are circumferentially spaced and have upstanding portions defined by sloping walls 27 which intersect at 28 and extend upwardly to terminate in flat faces 29. The faces 29 and the sloping walls 27 taper from a maximum width at the sides 23 of the clamping plate 21 inward to approximately zero width at 22 and the vertexes of the intersections as at 28 taper from maximum depth at the sides 23 of the clamping plate 21 upward to approximately zero depth at the central aperture 22 so that the serrations 26 face into the rounded edge of the central aperture 22. The clamping plate 21 has generally flat sides 23 at 90° to the flat faces 29 of the serrations 26 and the upstanding portions of the serrations 26 are chamferred or rounded adjacent the sides 23 to provide a smoother edge.

The radially directed serrations 26 are preferably provided on both faces of the clamping plate 21 although it is not mandatory to do so. If only one face of the clamping plate 21 is serrated, the serrations 26 are provided on the face of the clamping plate 21 remote from the head 18 of the screw 16. However, the vertexes 28 of the serrations 26 of one face are circumferentially spaced from the vertexes 28 of the serrations 26 of the other face when both faces of the clamping plate 21 are equipped with serrations 26 and the clamping plate 21 is mountable on the threaded shank 17 of the screw 16 with either face of the clamping plate 21 in confronting relation to the head 18.

The vertexes 28 on one side of the clamping plate 21 are positioned opposite the flat faces 29 of the serrations 26 on the reverse dies. The actual relationship of the serrations 26 on the two faces of the clamping plate 21 can be appreciated by referring to FIG. 7. The clamping plate 21 in the configuration set forth has essentially identical faces making the clamping plate 21 reversible to thereby cut the normal assembly rate at least in half due to elimination of the need for properly orienting the clamping plate 21 during assembly.

Looking at the head 18 of the screw 16 in somewhat greater detail, a central opening 30 is provided (as shown in FIGS. 1 and 2) which cooperates with a tool for rotating the threaded shank 17 into an opening such as the threaded aperture **14*a* in the terminal body 10. The central opening 30 includes a recess 31 adapted to receive a driver bit in a friction taper fit which is particularly desirable in an automated operation to effectuate driving the screw 16 into place during manufacture. The taper of the recess 31 provides space for the driver bit to rock into and become free from after torque application. The tilting terminal clamp 15** is therefore configured for automated manufacture.

The head 18 of the screw 16 also includes a slot 32 in conventional screw-like manner. The slot 32 is adapted to receive a typical screw driver for purposes of installation in the field. The recess 31 and the slot 32 of the central opening 30 provide a combination head that is adapted for automated driving in manufacture and hand driving in installation. Thus, the tilting terminal clamp 15 is adapted for use with automated driving bits or standard hand tools providing maximum versatility.

In the practice of the invention, the clamping plate 21 is placed on the blank of the screw 16 prior to threading and annulet forming operations. The projections and depressions of the interrupted annulet 25 and the threads on the threaded shank 17 are then formed on the blank of the screw 16 with a slight space between the conical ramp 20 and the interrupted annulet 25. The clamping plate 21 is then readily liftable along with the screw 16 by means of the interrupted annulet 25 when the screw is loosened for wire insertion.

The clamping plate 21 has a generally polygonal perimeter which is preferably octagonal with corners 24 adapted to engage the sidewalls 21 of the terminal body pocket 11 to prevent rotation of the clamping plate 21. The polygonal configuration of the clamping plate 21 facilitates driving the tilting terminal clamp 15 into the terminal body pocket 11 without pre-orientation. The clamping plate 11 cannot rotate under wire pull because at least one of the corners 24 and in some instances two of the corners 24 will make contact with the sidewalls 12. The clamping plate 21 also is well adapted for use in terminal body pocketts 11 with greater wall variations ranging from the major width (measured between diametrically opposed corners 24) and the minor width (measured between diametrically opposied sides 23) of the clamping plate 21. The novel clamping plate 21 of the present invention therefore overcomes many of the disadvantages of prior art clamping screws such as those with square clamping plates requiring pre-orientation and those with clamping plates that are round which require a very close tolerance between the sidewalls of a terminal body pocket in order to make contact.

The clamping plate 21 will tilt automatically to accommodate a single wire on one side only, or a large wire on one side and a small wire on the opposite wide, or a pair of wires of generally the same size on opposite sides. The tilting action of the clamping plate 21 is accomplished by the conical ramp 20 designed into the bottom of the head 18 of the screw 16 together with the central aperture 22 in the clamping plate 21. The conical ramp 20 together with the clamping plate 21 provides a spring load locking effect that is virtually vibration proof. The clamping plate 21 always bears on solid surfaces which further assists in holding the wire or wires in a stabilized position.

The clamping plate 21 has identical wire gripping surfaces in the form of radially directed serrations and identical central aperture contours on both sides so that no orientation is needed during assembly. The central aperture 22 of the clamping plate 21 has the configuration of a ring with a generally circular rounded edge to protect against binding of the clamping plate 21 on the screw 16. The clamping plate 21 and the screw 16 are made of the highest quality heat treated materials offering a strong product which can be assembled more than twice as fast as other contoured clamping plates because of the unique fastness of the present invention. The clamping plate 21 is therefore quicker to assemble, easier to deliver, faster to install, and potentially less expensive.

The head 18 of the screw 16 permits automatic driving by reason of the recess 31 in the central opening 30. The central opening 30 is preferably enlarged as a result of a standard screw driver slot 32 as seen in FIGS. 1 and 2 for use with standard tools by the electrician during final hook-up. The head 18 of the screw 16 preferably has a flat top to provide more material at the outer edge of the head 18 around the slot 32. The unique configuration of the head 18 in the screw 16 helps to eliminate slot strip-out that is quite common in standard type combination heads.

In the past, clamping plates have generally been square or rectangular thereby requiring orientation into a terminal body pocket during assembly. The orientation requirement necessitated manual labor during assembly to assure that the clamping plate was in proper position prior to installation. The tilting terminal clamp assembly of the present invention overcomes the requirement of manual handling during assembly to thereby permit automated manufacture.

During assembly of the tilting terminal clamp 15 of the present invention, an automated tool drives the screw 16 and the clamping plate 21 asembled thereon directly into the terminal body pocket 11 without requiring any prior orientation. The screw 16 and the clamping plate 21 can later be backed out for purposes of installing a wire or wires W by utilizing the screw driver slot 32 and the screw 16 and the clamping plate 21 can then again be tightened completing installation. The polygonal perimeter of the clamping plate 21 precludes the possibility of removal of the wire or wires W by means of a sharp pull after tightening the screw 16 since the corners 24 of the clamping plate 21 will engage the sidewalls 21 of the terminal pocket 11 thereby precluding rotation of the clamping plate 21. The serrations 26 of the clamping plate 21 also cooperate with the wire or wires W after the screw 16 has been tightened so that it is virtually impossible to turn the clamping plate 21 about the axis of the threaded shank 17 of the screw 16.

While in the foregoing specification, a detailed description of the invention has been set forth for purposes of illustration, many additional variations of the details herein given may be made by those skilled in the art without departing from the spirit and scope of the invention.

We claim:

1. A tilting terminal clamp comprising a threaded shank having a head at one extremity and a lead point at the other extremity, said head being configured to cooperate with a tool whereby the shank may be rotated into or out of a threaded aperture, a clamping plate substantially centrally apertured to loosely and tiltably receive said shank, said plate having a generally polygonal perimeter with said perimeter being equipped with 6, 8 or 10 flat sides and corners adapted to engage the sidewalls of a standard terminal body pocket receiving said clamp to prevent rotation of said clamping plate while at the same time avoiding the need for carefully orienting said plate within a terminal pocket, and means for retaining said plate on said shank adjacent said head.

2. The structure of claim 1 in which said plate has 8 sides.

3. A tilting terminal clamp assembly comprising a standard terminal body equipped with a wire receiving pocket having opposed generally parallel sidewalls and an end wall all upstanding from a terminal plate, said terminal plate being equipped with a threaded aperture for the receipt of the shank of a terminal clamp screw, said pocket being open at the top thereof for receipt of said terminal clamp and at one end thereof for receipt of said wire, said terminal clamp including a threaded shank integral with a head for rotating said shank, said shank being threadably received in said threaded aperture, a clamping plate centrally apertured and tiltably mounted on said shank adjacent said head, said plate having generally polygonal perimeter with said perimeter being equipped with 6, 8 or 10 flat sides and corners adapted to engage said sidewalls to prevent rotation of said clamping plate while at the same time avoiding the need for carefully orienting said plate within said pocket, and a wire between said clamping plate and said terminal plate urged there against by said tilting terminal clamp.

4. The structure of claim 3 in which said plate has 8 sides.

5. The structure of claim 3 in which said plate has upper and lower serrated surfaces, the serrations being generally radial and including flat surfaces on one surface positioned opposite to vertex parts on the other surface.

* * * * *